United States Patent [19]

McIntyre

[11] 4,062,546

[45] Dec. 13, 1977

[54] CHESS GAME APPARATUS

[76] Inventor: Roger L. McIntyre, P.O. Box 525, Chandler, Ariz. 85224

[21] Appl. No.: 704,369

[22] Filed: July 12, 1976

[51] Int. Cl.[2] ..... A63F 3/02

[52] U.S. Cl. ..... 273/136 F

[58] Field of Search ..... 273/136 R, 136 F, 136 E, 273/142 HA, 142 H, 148 R, 155; 116/133, 120; 40/70 R; 35/74, 28.3

[56] References Cited

U.S. PATENT DOCUMENTS

| | | | |
|---|---|---|---|
| 1,530,404 | 3/1925 | Pearce | 40/70 R |
| 1,714,839 | 5/1929 | Ashburn | 273/142 HA |
| 2,240,053 | 4/1941 | Richardson | 35/28.3 |

FOREIGN PATENT DOCUMENTS

| | | | |
|---|---|---|---|
| 701,570 | 1/1965 | Canada | 273/136 F |
| 374,474 | 4/1923 | Germany | 273/136 F |

*Primary Examiner*—Richard C. Pinkham
*Assistant Examiner*—Arthur S. Rose
*Attorney, Agent, or Firm*—Cahill, Sutton & Thomas

[57] ABSTRACT

A game apparatus including a board having discrete areas arrayed in chess board fashion, each area having a window therein and having associated therewith a dial having a working head exposed to the board and a shaft extending below the board, the shaft having a plurality of discs mounted thereon for rotation therewith, the discs having such identifying features thereon that rotation of the discs arranges such of those identifying features to be placed in registry with the window that the state of occupation of a discrete area can be viewed through the window.

7 Claims, 4 Drawing Figures

CHESS GAME APPARATUS

This invention relates to a game; more particularly, it relates to a game apparatus wherein the game is played with permanently affixed player pieces.

Games such as chess, checkers, and the like are played with a board and pieces which are moved from position to position on the board. The game must rest on a stable, flat surface to prevent inadvertant movement of the board and consequent dislocation of the pieces. This severely limits the locations and situations in which the game can be played. Exemplary patents relating to game apparatus designed to overcome this problem are U.S. Pat. Nos. 2,230,178; 2,637,738; 1,292,722; 1,087,797; 687,487; 3,128,098; 3,836,152; and 1,371,476. For those games having only a single type player piece per player, such as is the case in checkers, designing a game board with permanently affixed players is relatively simple. However, the problems are multiplied in the case of a game such as chess wherein each player has six different player pieces. In designing a game apparatus to accomodate the various player pieces, it is essential that operation of the apparatus per se be relatively easy and simple as otherwise such operation will detract from the basic play of the game itself.

It is an object of this invention to provide an apparatus for games conventionally played with a board and portable player pieces wherein the player pieces are affixed to the board so that player moves are accomplished without repositioning player pieces.

Another object is to provide such an apparatus wherein operation of the apparatus is relatively simple and easy.

These and other objects are provided by a game apparatus for playing a game having a plurality of pieces per player, the apparatus comprising a board having a pattern of discrete areas each having window means in association therewith, dial means mounted in association with each of said areas, the dial means including shaft means extending below the board, and disc means mounted below said board on the shaft means for rotation with the shaft means, the disc means having displayed thereon player identifying means, player piece identifying means, and blanking means denoting that the discrete area with which the disc means is associated is unoccupied, the disc means being selectively rotatable by the dial means to position such of the player identifying means, player piece identifying means, and blanking means beneath the window as is appropriate to display the state of occupation of the discrete area.

A preferred embodiment of the invention is illustrated in the accompanying drawings wherein.

Figure 1:
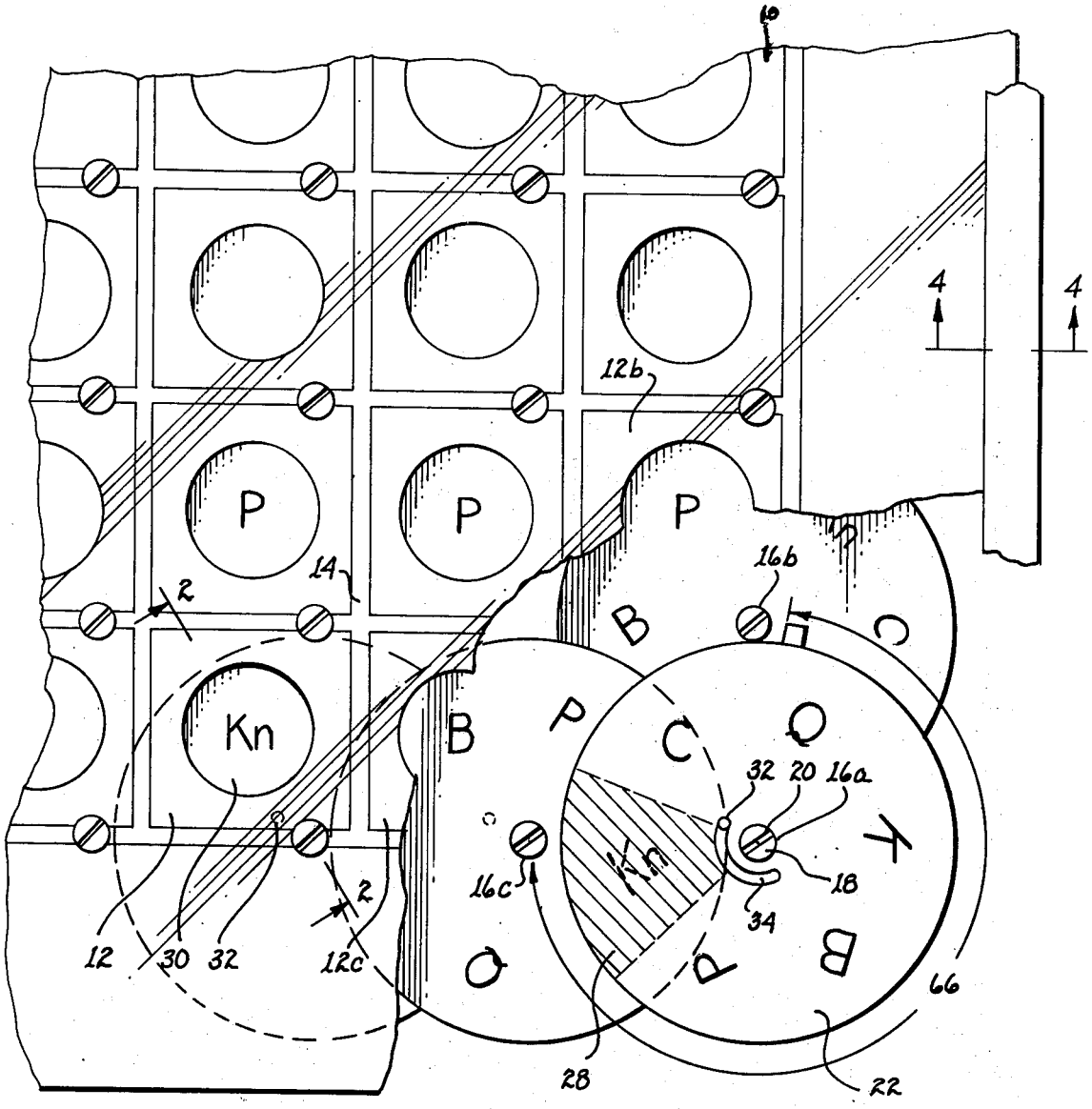
FIG. 1 is a plan view of the game board with portions cut away to show underlying elements.
Figure 2:
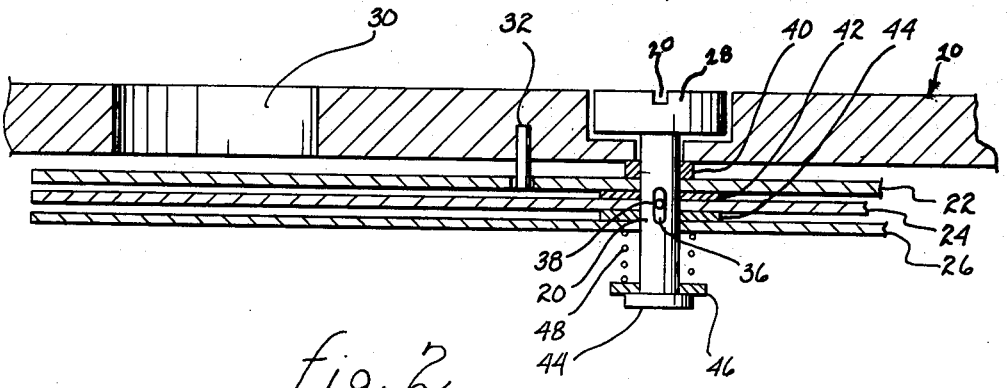
FIG. 2 is a sectional view taken along line 2—2 of FIG. 1.

Referring to FIGS. 1 and 2, a game board 10 is divided into individual areas 12 in the shape of squares each surrounded by a border 14. In a chess board, there are 64 such squares, alternating in color such as red and black. The board of FIG. 1 is cut away in the lower right-hand corner; the lower right-hand square being entirely removed and its contiguous squares each being partially cut-away. In the lower right-hand corner of each square is located a peg 16 having a head 18 which is preferably flush with the playing surface (see FIG. 2). Head 18 has a diametric slot 20 which receives a tool (not shown) to rotate peg 16. Peg 16 includes a vertical shaft 20 (see FIG. 2) on which is mounted three discs 22, 24 and 26. The uppermost disc 22 is a blanking disc having a segment 28. Each area 12 of board 10 is designated by a particular color. Segment 28 of disc 22 is colored with the same color as is employed to designate the area 12 for that square with which the disc 22 is associated. Each square 12 has a transparent window 30 here shown as a centrally located circle. In addition, each square 12 has associated therewith a pin 32 which communicates with semi-circular slot 34 in disc 22. A set of discs (discs 22,24 and 26) for a particular square will overlap sets of discs for contiguous squares; the sets being arranged so that one is entirely above or below the other to avoid interference.

Mounted for rotation on shaft 20 are discs 22, 24 and 26. Head 18 and a portion of shaft 20 are journalled in board 10. Shaft 20 includes a slot 36 containing a pin 38, the function of which is explained hereinafter. Between the lower surface of board 10 and disc 22 is a spacer 40 which maintains disc 22 in fixed vertically spaced relationship to board 10. Mounted on shaft 20 between discs 20 and 24 and discs 24 and 26 are friction washers 42 and 44. Shaft 20 is fitted with a butt 44 above which is located a retaining clip 46. Between retaining clip 46 and the undersurface of disc 26 is positioned a spring 48 which urges against disc 26 to maintain the discs in vertical, fixed alignment on shaft 20.

Figure 3:
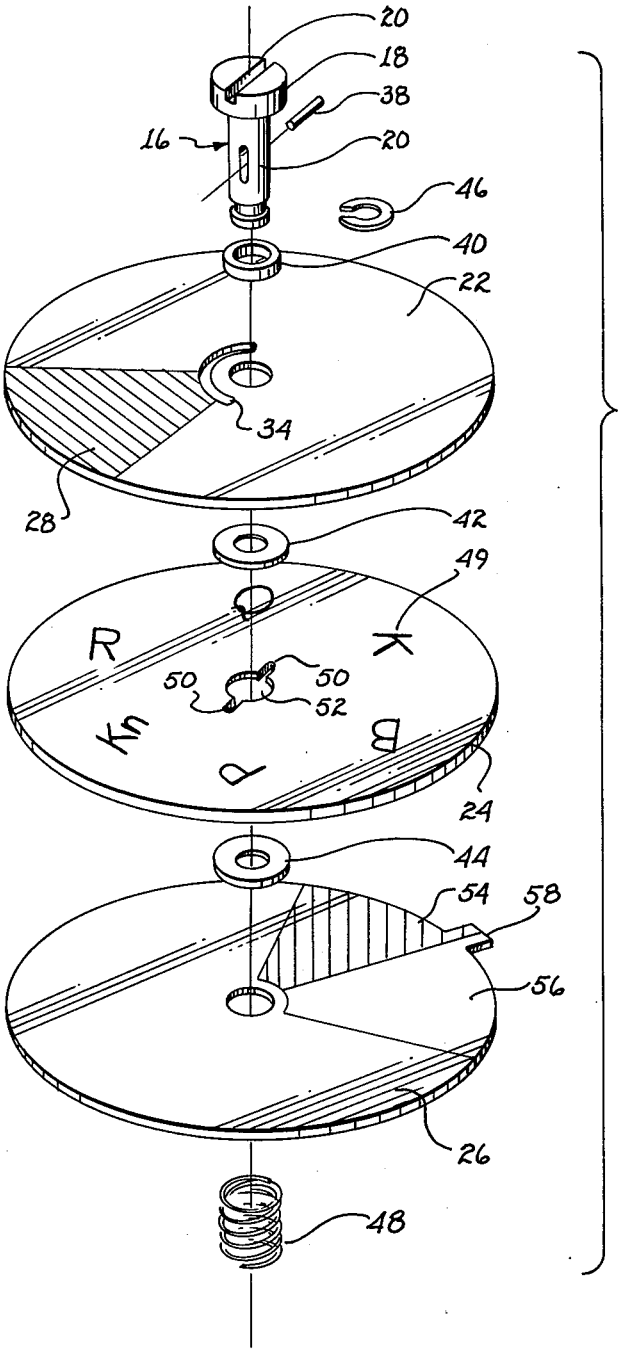
FIG. 3 is a perspective view in exploded form showing the arrangement of related components of the game apparatus.

In FIG. 3, the various components mounted on shaft 20 are shown. Disc 22 is preferably transparent except for segment 28 such that when segment 28 is in registry with window 30, the area 12 is designated as unoccupied. Disc 24 functions as a player piece identifying disc. The various player pieces are designated by appropriate insignia 49 such as letters identifying the player pieces (K=king; Q=queen; B=bishop; Kn=knight; P=pawn). The insignia, six in number for chess, are spaced about the periphery of disc 24 in positions which will place the insignia in registry with window 30 by rotating peg 16. Disc 24 has diametrically opposing notches 50 communicating with the central aperture 52. Notches 50 receive pin 38 to thereby key disc 24 to shaft 20. Disc 26 functions as a player identifying disc. In the case of chess, which is played by two players, each player is identified by a segment of disc 26. Disc 26 has two such segments, 54 and 56 differentiated by different colors. The remaining area of disc 26 is blank. Each of discs 22, 24 and 26 are preferably transparent, with the various identifying features printed thereon. Disc 26 is equipped with a tab 58 extending radially from the main body of the disc. Tab 58 is positioned between segments 54 and 56 for reasons explained hereinafter. In rotating peg 16, tab 58 will engage the shaft 20 of a contiguous square thereby stopping further rotation of disc 26 in the direction along which shaft 20 was approached.

Figure 4:
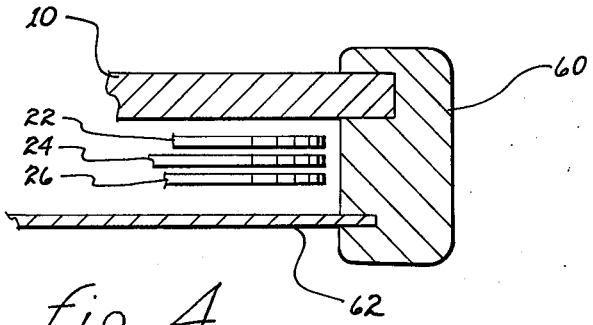
FIG. 4 is a sectional view taken along line 4—4 of FIG. 1.

The game board 10 is securably mounted in a frame 60 as shown in FIG. 4. Disposed below board 10 in parallel spaced relationship thereto is a cover 62 which serves to protect the moving parts of the game apparatus including discs 22, 24 and 26.

The game apparatus is operated in the following manner. The peg 16 is rotated so that each area 12 is occupied or unoccupied in accordance with the game rules. If an area 12 is initially unoccupied, peg 16 is rotated to the point where segment 28 on disc 22 is in registry with its associated window 30. Slot 34 in disc 22 extends across segment 28 and slightly beyond into the transparent area of disc 22 on either side of segment 28. Segment 28 is in registry with window 30 when pin 32 is intermediate the ends of slot 32. To remove segment 28 from registry with window 30, peg 16 is rotated in either direction causing disc 22 to rotate until pin 32 comes to the end of slot 34, at which point the transparent portion of disc 22 is in registry with window 30. Further rotation of peg 16 in the same direction will not cause rotation of disc 22 because of the stopping action of pin 32 provided by slot 34.

Peg 16 is further rotated until tab 58 engages a shaft 20 associated with an adjacent area 12. There are two such shafts which tab 58 may engage, one located on one side of window 30 and one on the other side. As seen in FIG. 1, these are the shafts associated with pegs **16*b* and 16*c*. Pegs 16*b* and 16*c* are associated with areas 12*b* and 12*c* which have a common side with area 12*a*. Because of tab 58, disc 26 can only rotate between pegs 16*b* and 16*c* throughout the angle designated as 66. When tab 58 abuts shaft of peg 16*c*, segment 56 is in registry with window 30. Thus, a particular player will always rotate a peg 16 in a single direction; the player identified by segment 54 will rotate pegs 16 counter-clockwise, and the player identified by segment 56 will rotate pegs 16 clockwise, so that the segment identified with the player will be in registry with window 30**.

At this juncture, discs 22 and 26 can no longer rotate in the direction of initial rotation due to pin 34 in the case of disc 22 and tab 58 in the case of disc 26. Disc 24, which is keyed to shaft 20 by pin 38, will continue to rotate, however, with rotation of peg 16. Rotation of peg 16 is halted when the appropriate player piece insignia 49 is in registry with window 30. Disc 22 is now positioned so that the transparent area is in registry with window 30, disc 24 is positioned so that the appropriate insignia 49 is in registry with window 30, and disc 26 is positioned so that the appropriate segment 54 or 56 is in registry window 30. The segment 54 or 56 provides a background for the insignia 49 so that one viewing the window 30 can identify both the player piece occupying the area 12 and the player owning such piece.

Changing player pieces occupying a particular area 12 without changing the player is accomplished simply by rotating peg 16 in the direction applicable for such player until the desired insignia 49 appears in window 30. To change players occupying the particular area 12, the peg 16 is rotated in the direction for that player until tab 58 engages the other shaft 20 serving as a stop for disc 26, thus placing the appropriate segment of disc 26 in registry with window 30. The appropriate player piece insignia 49 is then dialed into registry with window 30 by continuing rotation of peg 16 until registry is obtained. In the event the particular area 12 is to change from an occupied to an unoccupied state, peg 16 is merely rotated such that tab 58 moves away from its stop position to a point within angle 66 until blanking segment 28 of disc 22 is in registry with window 30. In the foregoing manner, all moves required for playing the game of chess can be accomplished by operating the pegs associated with the areas of the board involved in the move.

The invention has been described with respect to a preferred embodiment, it being understood that variations and modifications of such embodiment may be provided without departing from the spirit and scope of the invention. Exemplary of such modifications is the provision of suitable stopping members for tab 58 rather than utilizing the shafts of adjacent pegs for such purpose.

What is claimed is:

1. A game apparatus for playing a game employing two players and six player pieces per player, said game apparatus comprising:

a. a board having first discrete areas of a first color and second discrete areas of a second color different from said first color, said first and second discrete areas being arrayed in chessboard pattern, said board having window means associated with each of said first and second discrete areas;

b. dial means mounted on said board in association with each of said first and second discrete areas, said dial means including i. shaft means extending below said board, ii. first disc means mounted below said board on said shaft means for rotation therewith, said first disc means having a first player identifying feature and a second player identifying feature located in spaced relationship on said first disc means, iii. second disc means mounted below said board on said shaft means for rotation therewith, said second disc means having six player piece identifying features located in spaced relationship on said second disc means, and iv. third disc means mounted below said board on said shaft means for rotation therewith, said third disc means having a blank identifying feature and a transparent portion located thereon, said blank identifying feature denoting that a discrete area is unoccupied, said first, second, and third disc means being selectively positionable with respect to said window means in order that said window displays the state of occupation of said area; and c. first stop means for stopping said third disc means at a predetermined position such that said transparent portion of said third disc means is in registry with said window means.

2. The game apparatus of claim 1 wherein said first, second, and third disc means are in vertical stacked array, with said third disc means being below and adjacent said board, said second disc means being below and adjacent said third disc means, and said first disc means being below and adjacent said second disc means.

3. The game apparatus of claim 1 further comprising key means for keying said second disc means to said shaft means, and first friction means between said first and second disc means providing frictional engagement between said first and second disc means, and second friction means between said second and third disc means providing frictional engagement between said second and third disc means.

4. The game apparatus of claim 1 further comprising second stop means for stopping said first disc means at a predetermined position such that one of said first and second player identifying features is in registry with said window means.

5. The game apparatus of claim 1 wherein said third disc means includes slot means and said game apparatus further comprises pin means communicating with said slot means, said slot means being arranged with respect to said blank identifying feature such that upon said pin means reaching a terminus of said slot means said transparent portion is in registration with said window means.

6. The game apparatus of claim 1 wherein said first player identifying feature and said second player identifying feature of said first disc means are contiguous with each other, and said first disc means further comprises tab means extending outwardly from said first disc means, said tab means being located at the junction of said first and second player identifying features.

7. The game apparatus of claim 6 further comprising first and second stationary post means, said first stationary post means being spaced from said second stationary post means and located in intersecting relationship with said tab means whereby said post means provides stops for said tab means such that said first disc means is limited to rotation between said post means, and when said tab means is in abutting relationship with said first post means one of said player identifying features is in registration with said window means and when said tab means is in abutting relationship with said second post means the other of said player identifying features is in registration with said window means.

* * * * *